US005542215A

United States Patent [19]

Kubo

[11] Patent Number: 5,542,215

[45] Date of Patent: Aug. 6, 1996

[54] SASH SUPPORTING STRUCTURE OF HINGED SWINGING WINDOW

[75] Inventor: Yuichi Kubo, Kurobe, Japan

[73] Assignee: YKK Architectural Products Inc., Tokyo, Japan

[21] Appl. No.: 358,914

[22] Filed: Dec. 19, 1994

[30] Foreign Application Priority Data

Dec. 20, 1993 [JP] Japan ..... 5-319712

[51] Int. Cl.[6] ..... E05D 7/00

[52] U.S. Cl. ..... 49/397; 49/67

[58] Field of Search ..... 49/381, 397, 63, 49/67

[56] References Cited

U.S. PATENT DOCUMENTS

| | | | |
|---|---|---|---|
| 1,853,927 | 4/1932 | Plym | 49/387 |
| 2,115,935 | 5/1938 | Stinson | 49/67 |
| 2,124,696 | 7/1938 | Hall | 49/67 X |
| 2,278,666 | 4/1942 | Peremi et al. | 49/388 |
| 3,878,644 | 4/1975 | Brown et al. | 49/67 |
| 4,084,361 | 4/1978 | Aspaas . | |
| 4,132,035 | 1/1979 | Frambach | 49/381 X |

*Primary Examiner*—Jerry Redman

*Attorney, Agent, or Firm*—Finnegan, Henderson, Farabow, Garrett & Dunner, L.L.P.

[57] ABSTRACT

A sash supporting structure of a hinged swinging window includes a sash bar hinge secured to a horizontal rail of a sash and having a pivot shaft, and a support groove formed in a horizontal frame member of a window frame and pivotally receiving therein the pivot shaft of the sash bar hinge. The support groove has a width dimensioned such that the sash bar hinge can be inserted in the support groove from the inner periphery side of the window frame. With this arrangement, the sash can be readily installed in the window frame without requiring prior connection between the horizontal rail or the sash and the horizontal frame member. The sash supporting structure further has a dislocation stop member secured to the horizontal frame member of the window frame and extending through a cutout opening in the sash bar hinge to prevent horizontal in-plane displacement of the sash bar hinge. The dislocation stop member is engageable with a portion of the sash bar hinge to prevent dislocation of the sash bar hinge from the horizontal frame member of the window frame.

5 Claims, 4 Drawing Sheets

SASH SUPPORTING STRUCTURE OF HINGED SWINGING WINDOW

BACKGROUND OF THE INVENTION

1. Field of the Invention

The present invention relates generally to a hinged swinging window, and more particularly to a sash supporting structure of the hinged swinging window that supports a sash turnable on a horizontal frame member to open and close the window.

2. Description of the Prior Art

A sash of a hinged inswinging window turnable on a horizontal frame member to open toward the room interior side and like other sashes which are turnable about a horizontal axis or a vertical axis are usually supported by the window frame via hinges. These hinges are, however, expensive, require an adjustment of the plumb or verticality when the sash is mounted within the frame, and are exposed to the outside. In view of these drawbacks of the hinges, a sash bar hinge composed of a combination of profiled sash bars is used in place of the hinge according to the form, structure and size of the window.

U.S. Pat. No. 4,084,361 discloses a sash bar hinge composed of a circular pin or shaft formed at the free end of a ledge projecting interiorly from a frame member, and a tubular support portion formed integrally with a stile of a sash and embracing the shaft. Due to the embraced structure of the shaft, the sash bar hinge must be assembled by connecting the stile or the sash and the frame member before the sash is installed in the window frame. With this preassembling process, easy installation of the sash relative to the window frame or easy assembling of the overall window is difficult to achieve. Furthermore, for connection to the frame member, the sash is slid in the longitudinal direction of the frame member, so that a space which is equal in size to the sash must be provided around the window frame.

Moreover, since the support portion of the sash bar hinge embraces or surrounds the shaft, the stile and the frame member which constitute the sash bar hinge are both complicated in configuration, require specifically profiled sash bars, and cannot be worked or processed without difficulty.

The support portion which embraces the shaft also serves as a sash dislocation stop member. However, since the support portion is longitudinally slidable relative to the shaft, it may occur that when the shaft is horizontal, the sash is displaced horizontally. In order to prevent horizontal displacement of the sash, a separate sash slip-off stop member must be provided.

SUMMARY OF THE INVENTION

With the foregoing drawbacks of the prior sash bar hinges in view, an object of the present invention is to provide a sash supporting structure which is able to improve the sash mounting efficiency, can obviate the need for a frame member or a stile having a specific shape and configuration, and doubles in function as a sash dislocation stop member and a sash slip-off stop member.

According to a sash supporting structure of the present invention, a sash bar hinge having a pivot shaft is secured to a horizontal rail of a sash, and a horizontal frame member has a support groove in which the pivot shaft of the sash bar hinge is pivotally received. The support groove has a width dimensioned such that the sash bar hinge can be inserted in the support groove from the inner periphery side of a window frame. This arrangement makes it possible to attach the sash to the window frame without requiring prior connection between the horizontal rail or the sash and the horizontal frame member, thereby facilitating installation of the sash relative to the window frame. The sash bar hinge has a cutout opening through which a sash dislocation stop member extends. The sash dislocation stop member is secured to a horizontal frame member and engageable with the sash bar hinge in the longitudinal direction of the sash bar hinge. The dislocation stop member thus constructed also serves as a sash slip-off stop member.

Since the width of the support groove in the horizontal frame member is so dimensioned as to accept entry of the pivot shaft of the sash bar hinge in the support groove from the inner periphery side of the window frame, the sash can be installed in the assembled window frame from the inner periphery side of the latter by using pivotal movement of the sash about the pivot shaft. Thus, sash mounting work can be achieved at high efficiency without requiring a large space around the window frame.

The sash bar hinge has a pivot shaft which is received in the support groove and is engageable with a peripheral wall of the support groove at a region located on the open side of sash and the inner periphery side of the window frame, and a vertical face plate extending from the pivot shaft toward the sash and having a cutout opening for the passage therethrough of the sash dislocation stop member. The sash bar hinge is inserted in the support groove while it is held in contact with the peripheral wall of the support groove in two different directions. By virtue of the sash bar hinge, the horizontal frame member does not need to be shaped into a specific configuration and may be replaced with a frame member of another window. Since the sash bar hinge is secured to the horizontal bar as an integral part of the latter, the horizontal rail of the sash does not require to be shaped into a specific configuration and may be replaced with a rail of another window. Thus, the frame member and the rail can be also used as those in another window.

The sash dislocation stop member extends through the cutout opening in the sash bar hinge and secured to the horizontal frame member such that while the sash bar hinge turns about the pivot shaft, the sash dislocation stop member is engageable with a portion of the sash bar hinge at the open side of the support groove to prevent the sash bar hinge from removing from the support groove while restraining the horizontal displacement of the sash bar hinge in the plane of the window frame.

In the case where the sash bar hinge is supported while it is held in contact with the horizontal frame member, the hinge generally requires two separate parts provided to prevent the dislocation and slip-off of the sash bar hinge relative to the horizontal frame member. According to the present invention, the dislocation and the slip-off of the sash bar hinge can be prevented only by a single sash dislocation stop member. It is, therefore, possible to reduce the number of parts used. In addition, since the sash dislocation stop member has a shape not embracing the pivot shaft of the sash bar hinge and hence is simple in construction, can be produced from a portion of the sash bar, and makes it possible to save the production cost and the material cost.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

A preferred embodiment of the present invention will be described in greater detail with reference to the accompanying drawings.

Figure 1:
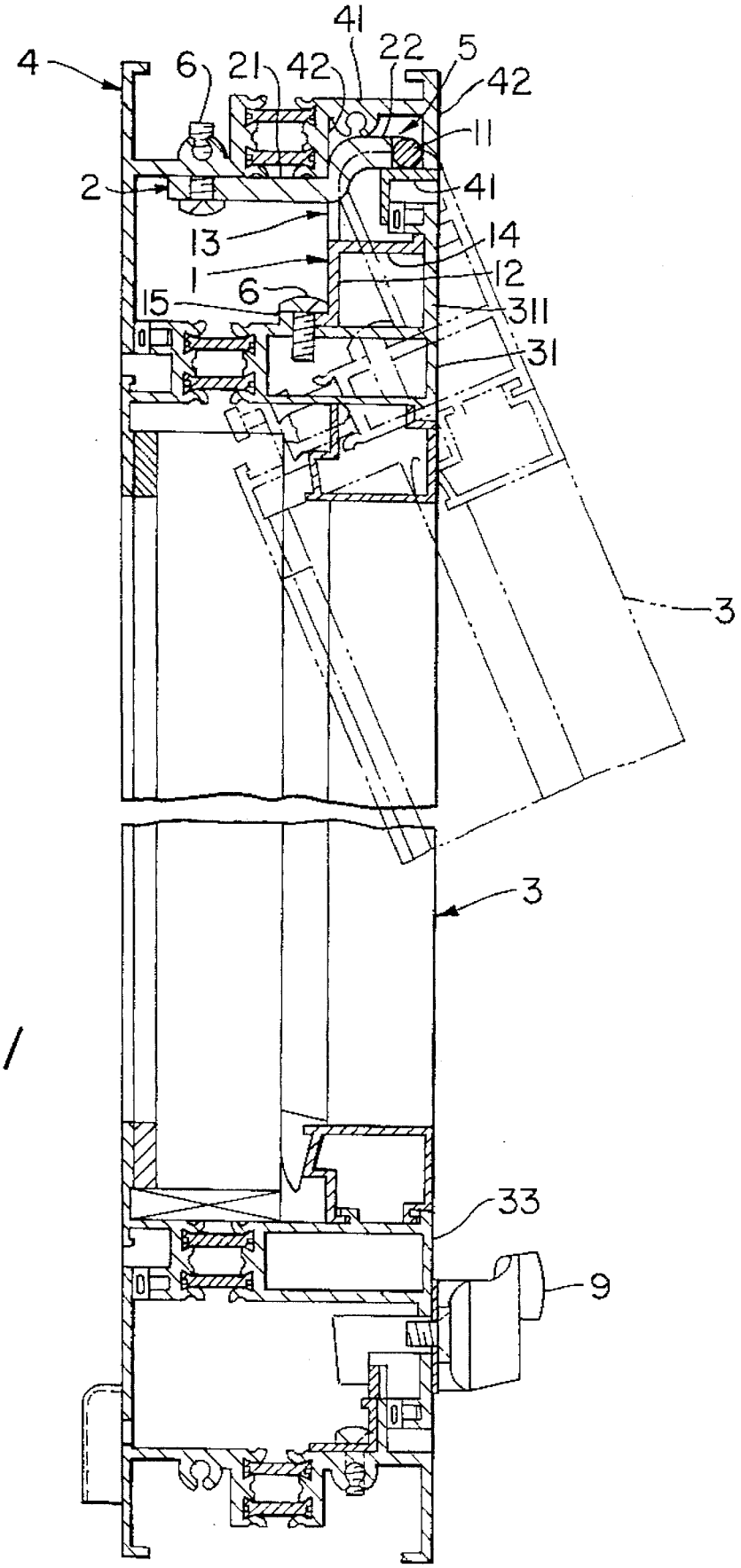
FIG. 1 is a vertical (x—x) cross-sectional view of FIG. 3 showing a sash bar hinge and a sash dislocation stop member as in an assembled condition.

As shown in FIG. 1, a sash supporting structure according to the present invention includes a sash bar hinge 1 formed from a profiled sash bar and having an integral pivot pin or shaft 11 pivotally received in a support groove 5 formed in an upper horizontal frame member or head 4 of a window frame. The sash bar hinge 1 is secured to an upper horizontal frame member or top rail 31 of a sash 3 which is pivotally mounted in the window frame to constitute a hinged swinging window shown in FIG. 1. The sash 3 is supported in such a condition that the dislocation of the sash bar hinge 1 from the head 4 and the in-plane horizontal displacement of the sash bar hinge 1 relative to the head 4 are both prevented by a sash dislocation stop member 2 secured to the head 4. The illustrated hinged swinging window is a top-hinged inswinging window wherein the sash 3 is turnable on the head 4 and opens toward the room interior side. By changing the direction of the sash 3 including the sash bar hinge 1, the top-hinged inswinging window can be changed into a top-hinged outswinging window, a bottom-hinged in-swinging window, and a bottom-hinged outswinging window.

Since the sash 3 in the illustrated embodiment is turned on the head 4 and opens toward the room interior side, the support groove 5 is provided on the open side of the sash 4 (i.e., the room interior side of the head 4). The support groove 5 is defined by a pair of parallel spaced horizontal depth plates 41, 41 and a pair of parallel spaced vertical face plates 42, 42. The pivot shaft 11 of the sash bar hinge 1 is held in contact with the interior vertical face plate 42 and the lower horizontal depth plate 41 and is pivotally supported by these plates 41, 42. The width of the support groove 5, which is equal to the distance between the lower horizontal depth plate 41 and the exterior vertical face plate 42, is dimensioned such that the pivot shaft 11 of the sash bar hinge 1 can be inserted into support groove 5 from the below, and within the width of the support groove 5, the sash bar hinge 1 is pivotally movable to open and close the sash 3.

The sash bar hinge 1 is composed of the pivot shaft 11 and a substantially vertical face plate 12 extending downwards from the pivot shaft 11 toward the sash 1 and having a cutout opening 13. The pivot shaft 11 is inserted in the support groove 5, is engageable with a peripheral wall of the support groove 5 and has a circular cross-sectional shape. The sash bar hinge 1 is secured by screws 6 (only one being shown in FIG. 1) to an appropriate plate of the top rail 31 at the vertical face plate 12 or a horizontal mounting plate 15 bent exteriorly from the lower end of the vertical face plate 12, such as shown in the illustrated embodiment. The sash bar hinge 1 further includes a horizontal depth plate 14 projecting interiorly from an intermediate portion of the vertical face plate 12 and held in abutment with a corner which is formed between an exteriorly facing surface and a downwardly facing surface of a vertical face plate 311 of the top rail 31. With this abutting engagement between the horizontal depth plate 14 and the vertical face plate 311, the sash bar hinge 1 can be stably attached to the top rail 31 without causing rotation or displacement relative to the top rail 31.

The sash dislocation stop member 2 is composed of an elongated rectangular plate having a base attachment portion 21 attached to the head 4, and a front end portion 22 extending through the cutout opening 13 in the vertical face plate 12 of the sash bar hinge 1. The front end portion 22 is engageable with opposed portions of an inner peripheral wall of the cutout opening 13 which define opposite ends of the cutout opening 13 in the longitudinal direction of the vertical face plate 12 (widthwise direction of the top rail 31 in the illustrated embodiment). The front end portion 22 is disposed such that the front end portion 22 is engageable with a portion of the sash bar hinge 1 at the open side of the support groove 5 while the sash bar hinge 1 is turned about the pivot shaft 11. The base attachment portion 21 is secured by screws 6 (only one being shown in FIG. 1) to an appropriate plate of the head 4. The sash dislocation stop member 2 may be placed on one or more portions of the sash bar hinge 1 arranged longitudinally of the sash bar hinge 1 depending on the width of the sash 3. Each sash dislocation stop member 2 is preferably secured such that it is held in contact with the inner peripheral wall of the corresponding cutout opening 13 in the longitudinal direction of the sash bar hinge 1 (widthwise direction of the top rail 31 in the illustrated embodiment), or it is slightly spaced from the inner peripheral wall of the cutout opening 13 so as to insure smooth pivotal movement of the sash bar hinge 1 on the head 4 but is engageable with the inner peripheral wall of the cutout opening 1 to prevent horizontal displacement of the sash bar hinge 1.

In the embodiment shown in FIG. 1, the front end portion 22 of the sash dislocation stop member 2 is bent upwardly to conform to the shape of a curved upper end portion of the vertical face plate 12 and has a front end face held in bearing contact with the exterior side of the pivot shaft 11 for guiding pivotal movement of the sash bar hinge 1. The front end face of the front end portion 22 is held in contact with the pivot shaft 11 at all times including the instance when the sash 1 is closed.

Figure 4:
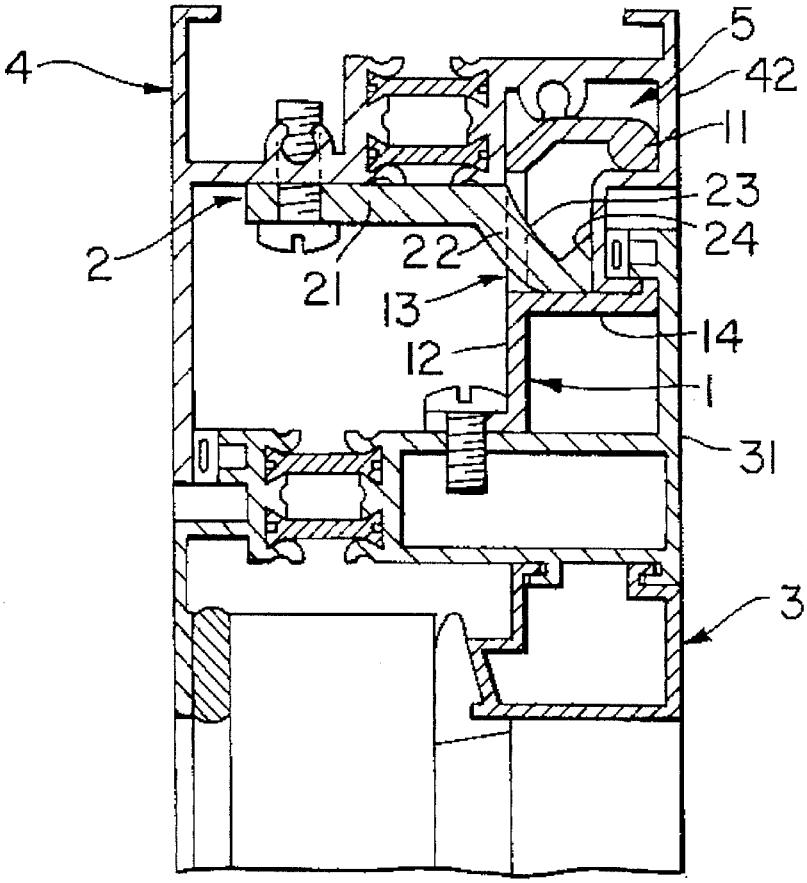
FIG. 4 is a vertical cross-sectional view showing a modified form of the sash dislocation stop member in an assembled condition.
Figure 5:
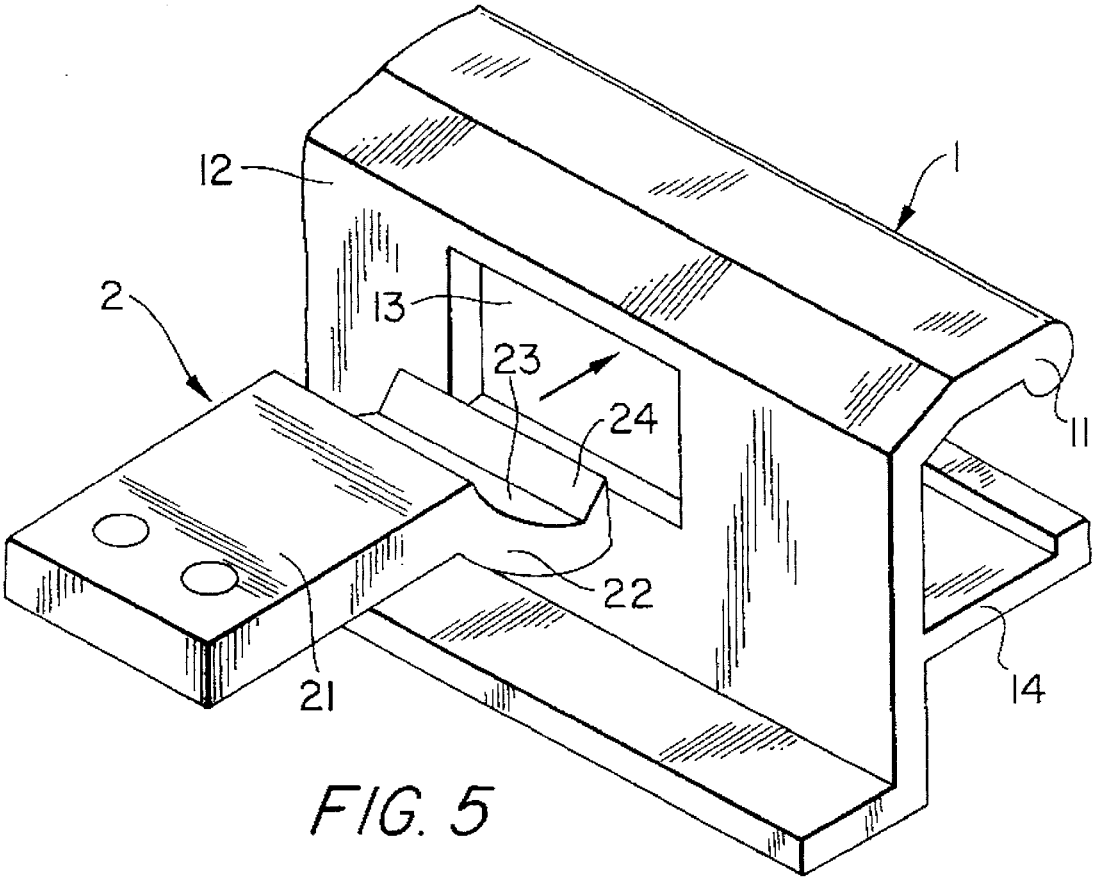
FIG. 5 is an exploded perspective view of the sash dislocation stop member shown in FIG. 4.
Figure 6:
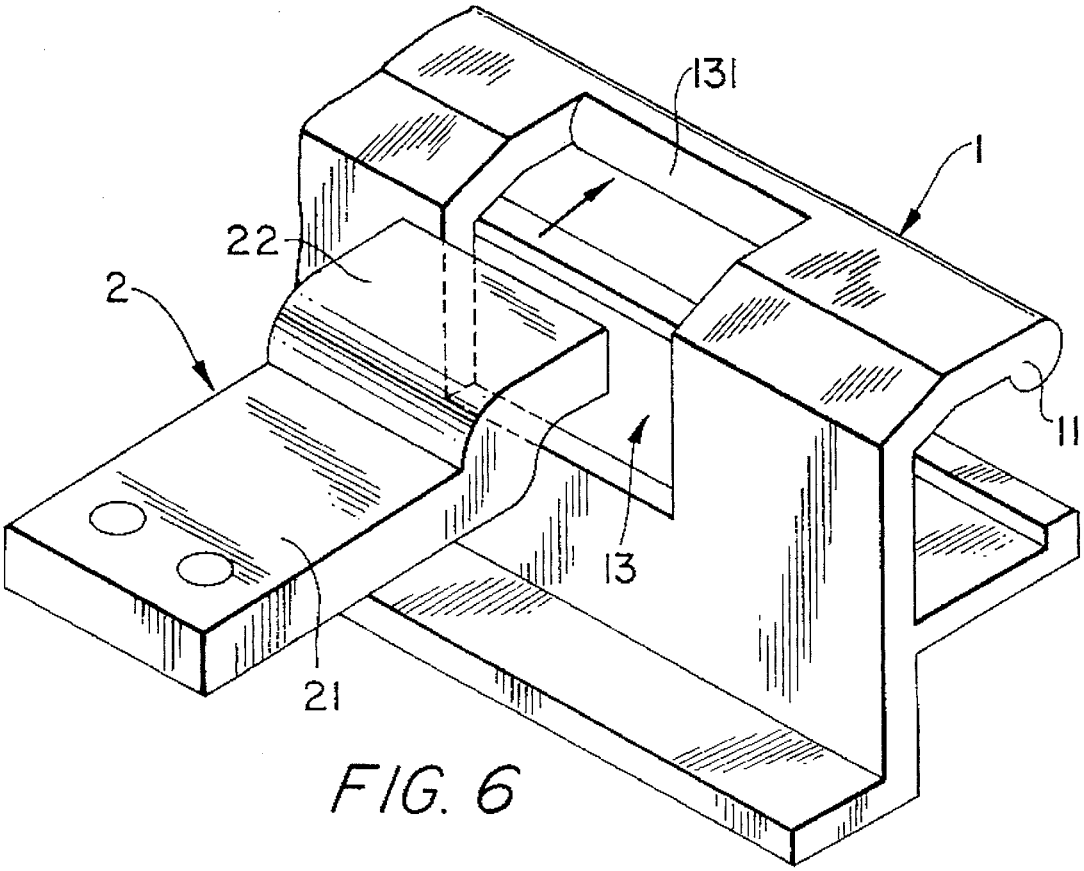
FIG. 6 is a perspective view of the relation of the sash bar hinge 1 and the stop member 2 shown in FIG. 1.

FIG. 4 illustrates a modified form of the sash supporting structure which includes a sash dislocation stop member 2 having a downwardly bent front end portion 22 held in abutment with a stepped interior vertical face plate (not designated) of the head 4. While the sash 3 is disposed in a closed position, the front end portion 22 is held in guided engagement with the horizontal depth plate 14 of the sash bar hinge 1 and is held out of contact with the pivot shaft 11 of the sash bar hinge 1. On the other hand, while the sash 3 is turned on the head 4, the inner peripheral wall of the cutout opening 13 in the vertical face plate 12 is brought into sliding engagement with, and hence is guided by, an arcuate guide surface 23 of the front end portion 22 which faces toward the pivot shaft 11. FIG. 5 illustrates the sash dislocation stop member 2 before it is inserted in the cutout opening 13 in the sash bar hinge 1. The front end portion 22 of the sash dislocation stop member 2 has on its upper surface a locking ridge 24 serving as a stopper which is engageable with an upper edge of the cutout opening 13 to limit a fully opened position of the sash 3.

Figure 2:
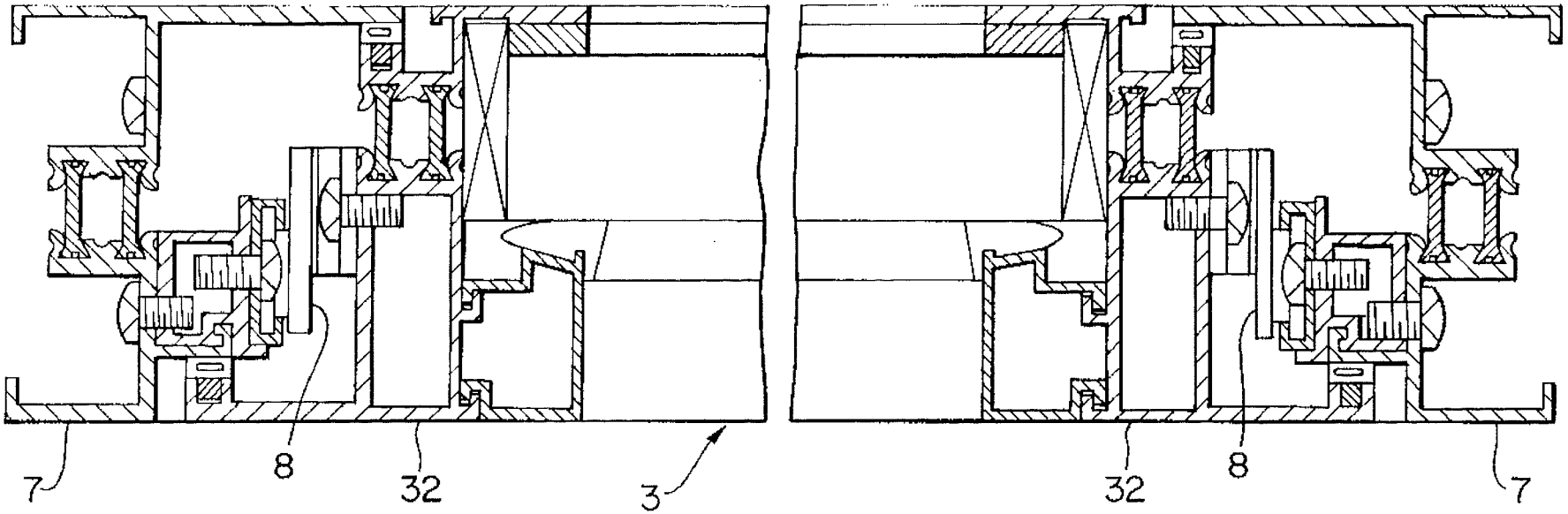
FIG. 2 is a horizontal (y—y) cross-sectional view of FIG. 3.
Figure 3:
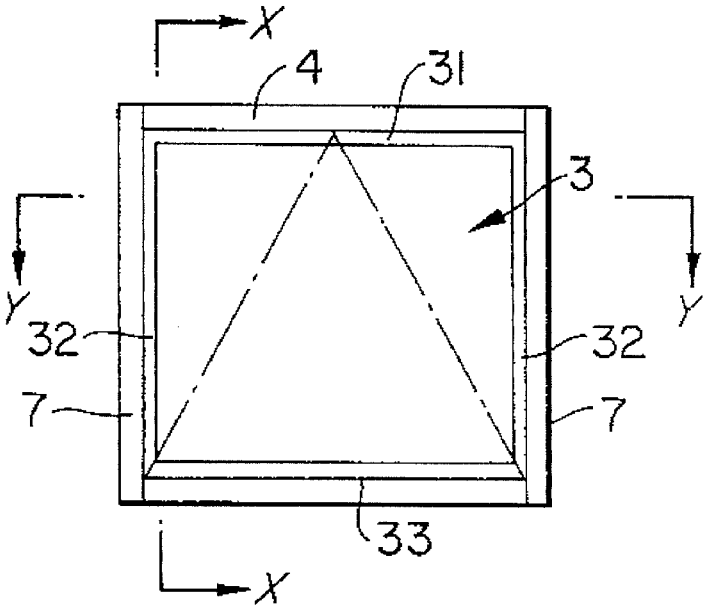
FIG. 3 is a front elevational view of a hinged swinging window.

As shown in FIG. 2, the sash 3 has left and right vertical frame members or stiles 32, 32 linked with left and right vertical frame members or jambs 7, 7 of the window frame via a pair of arms 8. The sash 3 is opened and closed by manipulating a handle 9 attached to the other horizontal frame member 33, namely the bottom rail in the illustrated embodiment, of the sash 3.

As described above, the sash supporting structure of this invention includes a sash bar hinge secured to a horizontal frame member of a sash and having a pivot shaft, and a support groove formed in a horizontal frame member of a window frame and pivotally receiving therein the pivot shaft of the sash bar hinge. The support groove has a width large enough to accept entry of the sash bar hinge in the support groove from the inner periphery side of the window frame. Thus, the sash can be installed in the assembled window frame by utilizing a rotary motion of the sash bar hinge about the pivot shaft received in the support groove. Thus, the sash can be readily received in the window frame without requiring a large space provided around the window frame.

A sash dislocation stop member which is secured to the horizontal frame member of the window frame extends through a cutout opening formed in the sash bar hinge. The sash dislocation stop member is engageable with the sash bar hinge in the longitudinal direction of the sash bar hinge and also is able to contact a portion of the sash bar hinge at an open side of the support groove. The sash dislocation stop member thus constructed is a single part but doubles in function as a sash dislocation stop member and a sash slip-off stop member.

Since the sash bar hinge is inserted in the support groove while it is held in contact with the peripheral wall of the support groove in two different directions, the horizontal frame member of the window frame does not require to have a specific shape and configuration. Accordingly, the horizontal frame member can be replaced with a horizontal window frame member of another window. In addition, the sash bar hinge is secured to the horizontal frame member of the sash as an integral part, the horizontal sash frame member should by no means be shaped into a specific configuration. Accordingly, the window frame member and the sash frame member can be replaced with those of another window.

Furthermore, the sash dislocation stop member has a shape not directly embracing the pivot shaft of the sash and hence is simple in construction, can be produced from a portion of the sash bar, and makes it possible to reduce the production cost and the material cost.

Obviously, various minor changes and modifications of the present invention are possible in the light of the above teaching. It is therefore to be understood that within the scope of the appended claims the invention may be practiced otherwise than as specifically described.

What is claimed is:

1. A sash supporting structure for pivotally supporting a sash within a window frame of a hinged swinging window, the sash having a horizontal frame member corresponding in position to a horizontal frame member of the window frame, said sash supporting structure comprising:

(a) sash bar hinge attached to the horizontal frame member of the sash and including a pivot shaft, and a vertical face plate extending from said pivot shaft toward the sash and having a cutout opening;

(b) means defining a support groove extending in the horizontal frame member of the window frame and pivotally receiving therein said pivot shaft of said sash bar hinge, said support groove having a width dimensioned such that said sash bar hinge can be inserted in said support groove from an inner periphery side of the window frame; and (c) a sash dislocation stop member attached to the horizontal frame member of the window frame and extending through said cutout opening in said sash bar hinge to prevent the sash bar hinge from displacing in a horizontal direction in a plane of the window frame, said sash dislocation stop member, at least during pivotal movement of the sash bar hinge, being engageable with a portion of said sash bar hinge at an open side of said support groove to prevent said sash bar hinge from dislocating from the horizontal frame member of the window frame.

2. A sash supporting structure according to claim 1, wherein said sash dislocation stop member has an end portion always held in bearing contact with a portion of said pivot shaft of said sash bar hinge.

3. A sash supporting structure according to claim 1, wherein said sash dislocation stop member has an end portion held out of contact with said pivot shaft of said sash bar hinge, and an arcuate guide surface facing toward said pivot shaft, said guide surface being slidably engageable with an inner peripheral wall of said cutout opening to guide the movement of said sash bar hinge while said sash bar hinge is turned about said pivot shaft.

4. A sash supporting structure according to claim 3, wherein said end portion of said sash dislocation stop member further has a locking portion contiguous to said guide surface and lockingly engageable with the inner peripheral wall of said cutout opening to limit a fully opened position of the sash.

5. A sash supporting structure according to claim 1, wherein said sash bar hinge further has a horizontal depth plate projecting from an intermediate portion of said vertical face plate and held in abutment with a vertical face plate of the horizontal frame member of the sash.

* * * * *